US008522828B2

(12) United States Patent
Merry

(10) Patent No.: US 8,522,828 B2
(45) **Date of Patent: *Sep. 3, 2013**

(54) INSULATED DOUBLE-WALLED EXHAUST SYSTEM COMPONENT AND METHOD OF MAKING THE SAME

(75) Inventor: Richard P. Merry, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 193 days.

This patent is subject to a terminal disclaimer.

(21) Appl. No.: 12/303,447

(22) PCT Filed: May 23, 2007

(86) PCT No.: PCT/US2007/069543

§ 371 (c)(1),
(2), (4) Date: Dec. 4, 2008

(87) PCT Pub. No.: WO2007/146568

PCT Pub. Date: Dec. 21, 2007

(65) Prior Publication Data

US 2009/0277526 A1 Nov. 12, 2009

Related U.S. Application Data

(60) Provisional application No. 60/804,860, filed on Jun. 15, 2006.

(51) Int. Cl.
*F16L 9/14* (2006.01)
*F01N 3/02* (2006.01)

(52) U.S. Cl.
USPC ..... 138/149; 138/148; 181/231; 181/252; 181/256

(58) Field of Classification Search
USPC ..... 138/114, 148, 149; 181/231, 243, 181/252, 256, 258
See application file for complete search history.

(56) References Cited

U.S. PATENT DOCUMENTS

| | | | | |
|---|---|---|---|---|
| 3,365,315 | A | 1/1968 | Beck et al. | 501/33 |
| 3,792,136 | A | 2/1974 | Schmitt | 264/44 |
| 3,891,009 | A | 6/1975 | Noda | |
| 3,935,632 | A * | 2/1976 | Maxson | 29/455.1 |
| 3,958,582 | A | 5/1976 | Noda | |
| 4,039,480 | A | 8/1977 | Watson et al. | 502/9 |
| 4,348,243 | A * | 9/1982 | Craubner | 156/71 |

(Continued)

FOREIGN PATENT DOCUMENTS

| | | |
|---|---|---|
| EP | 0 285 804 A1 | 10/1988 |
| EP | 1 464 800 A1 | 10/2004 |

(Continued)

OTHER PUBLICATIONS

PCT Written Opinion of the International Searching Authority, PCT/US2007/069543, mailed Dec. 12, 2007.

(Continued)

*Primary Examiner* — Patrick F Brinson
(74) *Attorney, Agent, or Firm* — Bradford B. Wright

(57) ABSTRACT

A double-walled exhaust system component having glass bubbles disposed between inner and outer pipes and method of making the same. The glass bubbles have a size distribution wherein, on a bulk volume basis, at least 90 percent of the glass bubbles have a size of less than 150 micrometers.

20 Claims, 2 Drawing Sheets

(56) References Cited

U.S. PATENT DOCUMENTS

| | | | | | |
|---|---|---|---|---|---|
| 4,391,646 | A | | 7/1983 | Howell | 523/219 |
| 4,637,990 | A | | 1/1987 | Torobin | |
| 4,657,810 | A | | 4/1987 | Douden | |
| 4,680,239 | A | | 7/1987 | Yano et al. | |
| 4,768,455 | A | * | 9/1988 | Maxson et al. | 114/264 |
| 4,975,314 | A | | 12/1990 | Yano et al. | 428/216 |
| 5,024,289 | A | | 6/1991 | Merry | |
| 5,151,253 | A | | 9/1992 | Merry | 422/179 |
| 5,419,127 | A | | 5/1995 | Moore | 60/322 |
| 5,697,215 | A | | 12/1997 | Canevet et al. | |
| 5,777,947 | A | | 7/1998 | Ahuja | 367/1 |
| 5,795,102 | A | * | 8/1998 | Corbishley | 405/171 |
| 6,058,979 | A | * | 5/2000 | Watkins | 138/149 |
| 6,077,483 | A | * | 6/2000 | Locker et al. | 422/179 |
| 6,155,046 | A | | 12/2000 | Kato et al. | 60/323 |
| 6,182,705 | B1 | * | 2/2001 | Sumner | 138/140 |
| 6,519,936 | B2 | | 2/2003 | Smatloch et al. | 60/297 |
| 6,726,884 | B1 | | 4/2004 | Dillon et al. | 422/179 |
| 6,910,507 | B2 | * | 6/2005 | Simon et al. | 138/146 |
| 6,923,942 | B1 | * | 8/2005 | Shirk et al. | 422/179 |
| 2003/0215640 | A1 | | 11/2003 | Ackerman et al. | 428/405 |
| 2006/0169344 | A1 | * | 8/2006 | Toole | 138/149 |
| 2007/0163250 | A1 | * | 7/2007 | Sane et al. | 60/323 |
| 2009/0277526 | A1 | | 11/2009 | Merry | |
| 2010/0126618 | A1 | | 5/2010 | D'Souza et al. | |

FOREIGN PATENT DOCUMENTS

| | | | |
|---|---|---|---|
| JP | 59-39135 | B | 10/1984 |
| JP | 61-163282 | | 7/1986 |
| JP | 62-211138 | | 9/1987 |
| JP | 8-200050 | | 8/1996 |
| JP | 9-504072 | U | 4/1997 |
| JP | 2001-172031 | | 6/2001 |
| JP | 2004-138057 | A | 5/2004 |
| JP | 2004/138057 | A | 5/2004 |
| WO | 2006/024010 | A2 | 3/2006 |
| WO | 2007/146568 | A2 | 12/2007 |
| WO | 2007/146568 | A3 | 12/2007 |
| WO | 2007/146618 | A1 | 12/2007 |

OTHER PUBLICATIONS

"Product Information, 3M Scotchlite™ Glass Bubbles, K Series, S Series", Dec. 2003, 3M Performance Materials Division, 3M Company, St. Paul, MN, pp. 1-8.

"3M™ Microspheres Selection Guide", Jan. 2003, 3M Specialty Materials, 3M Company, St. Paul, MN, pp. 1-8.

"Product Information, Zeeospheres™ Ceramic Microspheres Gray Grades", Jan. 2003, , 3M Specialty Materials, 3M Company, St. Paul, MN, pp. 1-2.

"Product Information, 3M Z-Light Spheres™ Ceramic Microspheres Gray Grades", Jun. 2000, 3M Specialty Materials, 3M Company, St. Paul, MN, pp. 1-2.

3M Ceramic Microspheres, Paints and Coatings Applications Profile, Nov. 2003, 3M Performance Materials Division, 3M Company, St. Paul, MN, pp. 1-6.

Merry, "Insulated Double-walled Exhaust System Component and Method of Making the Same", U.S. Appl. No. 60/804,862, filed Jun. 15, 2007.

Merry, "Insulated Double-walled Exhaust System Component and Method of Making the Same", U.S. Appl. No. 60/804,860, filed Jun. 15, 2007.

Merry, "Insulated Double-walled Exhaust System Component and Method of Making the Same", U.S. Appl. No. 12/303,433, filed Jun. 1, 2007.

Extended European Search Report, European Patent Application No. 07797683.5-2321/2032815 PCT/US2007069543, Apr. 26, 2010, pp. 1-6.

Office Action dated Jul. 22, 2011 in U.S. Appl. No. 12/303,433, filed Dec. 4, 2008, 13 pages.

* cited by examiner

INSULATED DOUBLE-WALLED EXHAUST SYSTEM COMPONENT AND METHOD OF MAKING THE SAME

CROSS-REFERENCE TO RELATED APPLICATIONS

This application is a national stage filing under 35 U.S.C. §371 of PCT/US2007/069543, filed May 23, 2007, which claims priority to U. S. Provisional Application No. 60/804,860, filed Jun. 15, 2006, the disclosure of which is incorporated by reference in its entirety herein.

BACKGROUND

Catalytic converters used in motor vehicles typically operate most efficiently at high temperatures. Upon starting the engine the catalytic converter temperature needs to rise sufficiently that it performs properly, a process commonly termed "light off". "Light off" is normally defined as the temperature at which the catalytic converter reaches 50 percent efficiency. Depending on pollutant type, this typically occurs in a range of from about 200-300° C. One method of reducing light off time is to increase the temperature of exhaust gas arriving at the catalytic converter. To address this problem, and/or to protect sensitive vehicle components (for example, electronics, plastic parts, or the like) from heat given off by the vehicle exhaust, various double-walled exhaust system components (for example, exhaust manifolds, end cones for attaching to a catalytic converter, exhaust pipes, or pipes) have been developed. Such components generally have an inner pipe within an outer pipe. The annular gap formed between the inner pipe and the outer pipe may be left open or filled with an insulating material such as for example, a ceramic fiber mat.

Recently, there has been a trend toward the use of catalytic converters with diesel engines, which typically generate cooler exhaust gases than gasoline engines (for example, 200-300° C.). Accordingly, maintaining exhaust gas temperatures upstream of the catalytic converter is desirable in the case of diesel engines.

Effectively insulating a double-wall exhaust system component can be particularly challenging, for example, if the component has bends in it and/or if the annular gap formed between the inner and outer pipes is not uniform. This typically makes it difficult to fit anything in sheet form between the two pipes.

SUMMARY

In one aspect, the present invention provides an insulated double-walled exhaust system component comprising an inner pipe, an outer pipe surrounding the inner pipe, first and second annular seals connecting the inner and outer pipes and together with the inner and outer pipes defining an enclosed cavity, and glass bubbles at least partially filling the enclosed cavity, the glass bubbles having a size distribution wherein, on a bulk volume basis, at least 90 percent of the glass bubbles have a size of less than 150 micrometers.

In some embodiments, the double-walled exhaust system component, which may be disposed upstream of a catalytic converter, is connected to a gasoline or diesel engine such that exhaust gas from the engine is directed through the inner pipe. In some embodiments, the insulated double-walled exhaust system component is selected from the group consisting of an insulated double-walled exhaust pipe, an insulated double-walled end cone of a catalytic converter assembly, an insulated double-walled spacer ring of a catalytic converter assembly, an insulated double-walled muffler, and an insulated double-walled tail pipe.

In another aspect, the present invention provides a method of making an insulated double-walled exhaust system component, the method comprising: providing an inner pipe; at least partially confining the inner pipe within an outer pipe; connecting the inner and outer pipes to form a fillable cavity having at least one opening; at least partially filling the fillable cavity with glass bubbles having a size distribution wherein, on a bulk volume basis, at least 90 percent of the glass bubbles have a size of less than 150 micrometers; and sealing said at least one opening and enclosing the glass bubbles.

In some embodiments, the inner pipe and outer pipe are connected by at least one seal, wherein the inner pipe, outer pipe, said at least one seal, and the opening form the fillable cavity.

In some embodiments, on a bulk volume basis, at least 90 percent of the glass bubbles have a size of less than 140, 130, 120, or 110 micrometers. In some embodiments, on a bulk volume basis, greater than 50 percent of the glass bubbles have a size of greater than 50 micrometers. In some embodiments, the glass bubbles have a true density in a range of from 0.1 to 0.15 grams per milliliter. In some embodiments, at least one of the inner pipe and the outer pipe comprises stainless steel, steel, or a steel alloy. In some embodiments, the enclosed cavity is substantially filled with the glass bubbles. In some embodiments, the glass bubbles are tightly packed.

The present invention provides thermal and sound insulating properties to double walled exhaust system components, and may be easily packed into the cavity (that is, annular gap) between the inner and outer pipes. Furthermore, in many embodiments these benefits can be achieved using commercially available and economical materials.

As used herein, the term:

"pipe" refers to a tube which may be cylindrical, tapered, flattened, and/or bent, and which may have a varying cross-sectional shape and/or size along its length; for example, the term pipe includes typical end cones for catalytic converters;

"exhaust pipe" refers to pipe between the exhaust manifold and the catalytic converter or muffler;

"exhaust system component" refers to a component designed to direct exhaust gas from a burner or engine; and "tail pipe" refers to pipe downstream of the muffler and which vents directly to the atmosphere.

These figures, which are idealized, are intended to be merely illustrative and non-limiting.

DETAILED DESCRIPTION

Figure 1:
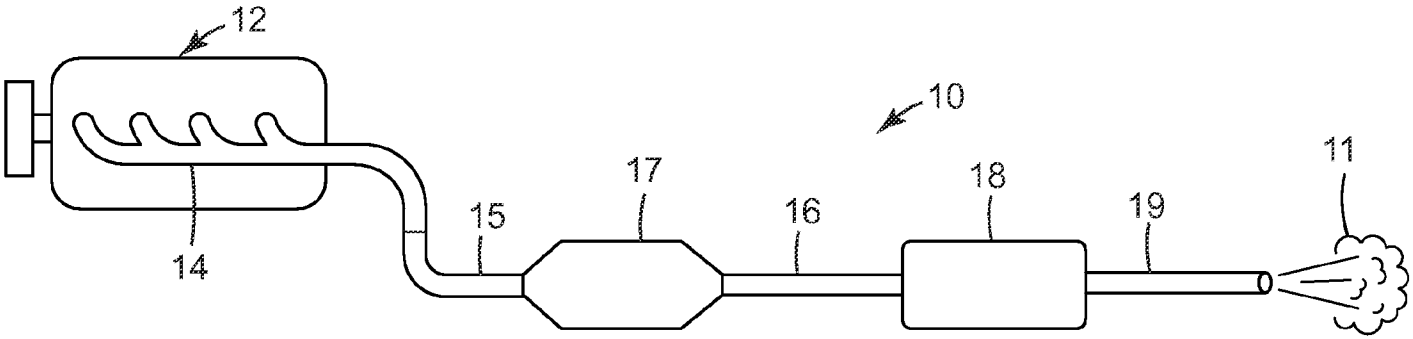
FIG. 1 is a schematic view of an exemplary motor vehicle exhaust system.

An exemplary exhaust system of a motor vehicle is shown in FIG. 1. In normal operation, engine 12 introduces exhaust gas 11 into exhaust manifold 14. Exhaust gas 11 passes through exhaust system 10 and is emitted from tail pipe 19. Exhaust manifold 14 is connected to first exhaust pipe 15. Catalytic converter assembly 17 is disposed between first and second exhaust pipes 15, 16. Second exhaust pipe 16 is connected to muffler 18, which is connected to tail pipe 19.

Figure 2:
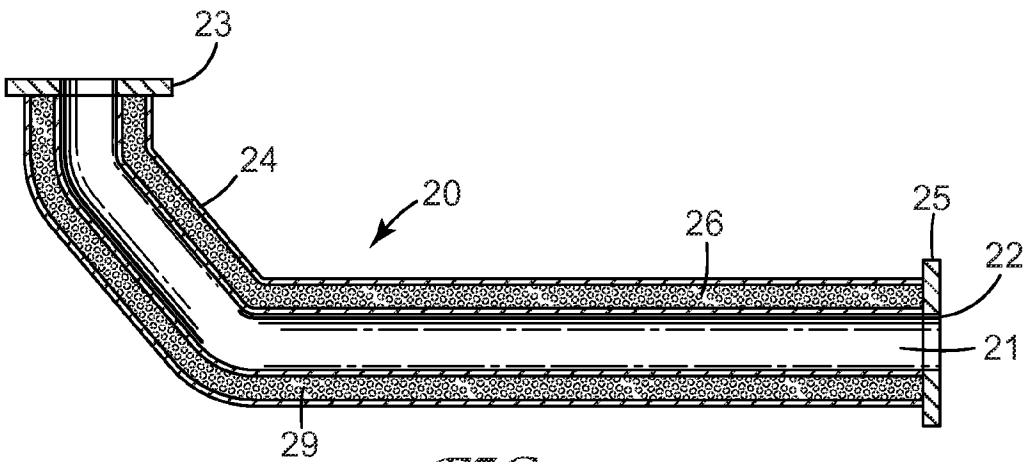
FIG. 2 is a longitudinal cross-sectional view of an exemplary double-walled insulated exhaust pipe containing glass bubbles.

One exemplary insulated double-walled exhaust system component according to the present invention is shown in FIG. 2. Referring now to FIG. 2, insulated double-walled exhaust pipe 20 comprises inner pipe 22, outer pipe 24 surrounding inner pipe 22, first and second annular seals 23, 25 connecting the inner and outer pipes 22, 24 and together with the inner and outer pipes 22, 24 defining an enclosed cavity 29. Glass bubbles 26 are disposed within enclosed cavity 29. Glass bubbles 26 have a size distribution wherein at least 90 percent of the glass bubbles have a size of less than 150 micrometers. Inner pipe 22 surrounds an interior space 21, through which exhaust gas flows if the exhaust pipe used in an exhaust system of a motor vehicle.

Figure 3:
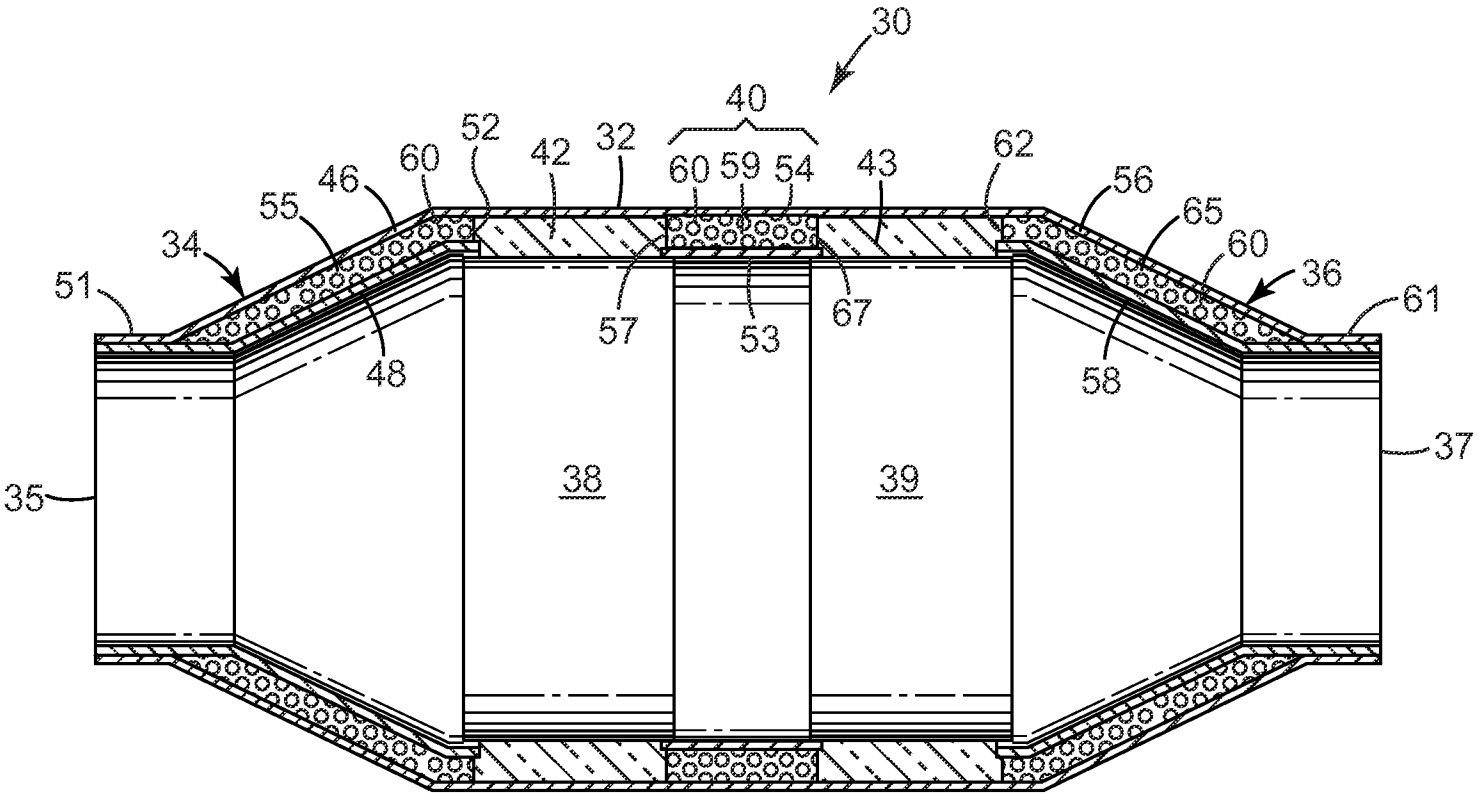
FIG. 3 is a longitudinal cutaway view of an exemplary catalytic double-walled insulated converter assembly containing glass bubbles.

FIG. 3 shows an exemplary catalytic converter assembly 30 that includes an insulated double-walled end cones and an insulated double-walled spacer ring according to the present invention. Inlet end cone 34 has inlet 35 and terminates at first mounting mat 42 which retains first catalytic element 38. Outlet end cone 36 has outlet 37 and terminates at second mounting mat 43 which retains second catalytic element 39. Insulated double-walled spacer ring 40 is disposed between first and second mounting mats 42, 43. Housing 32, which is also commonly referred to as a can or casing, can be made of any suitable material known for this purpose in the art and is typically of metal; for example, stainless steel. First and second catalytic elements 38, 39 are formed of a honeycombed monolithic body, typically either of ceramic or metal. Surrounding catalytic elements 38, 39 are first and second mounting mats 42, 43 which are generally made of intumescent material. First and second mounting mats 42, 43 should maintain a sufficient holding power of catalytic elements 38, 39, respectively, when the gap between housings 32, 33 and catalytic elements 38, 39 widens when hot exhaust gas flows through the pollution control device.

Inlet end cone 34 has first outer pipe 46 and first inner pipe 48. Outlet end cone 36 has second outer pipe 56 and second inner pipe 58. Inlet end cone 34 has first and second end seals 51, 52 that define enclosed first cavity 55. Outlet end cone 36 has third and fourth end seals 61, 62 that define enclosed first cavity 65. Spacer ring 40 has third inner and outer pipes 53, 54, respectively, and fifth and sixth end seals 57, 67 that define third enclosed cavity 59. Enclosed cavities 55, 65, 59 are filled with glass bubbles 60.

The inner and outer pipes may be made of any material capable of withstanding elevated temperatures associated with exhaust gas emissions from internal combustion engines. Typically, the inner and outer pipes comprise metal such as, for example, steel, stainless steel, or a steel alloy (for example, as available under the trade designation "INCONEL" from Special Metals Corp., Huntington, W. Va.).

The first and second seals may have any form that serves to form an enclosed cavity between the inner and outer pipes. Examples of seals include flanges, collars, welds, and crimps, optionally in combination with one or more welds or sealants, glass, and ceramics. The first and second seals may be made of any material capable of withstanding elevated temperatures associated with exhaust gas emissions from internal combustion engines. The seals should be essentially free of holes that can allow glass bubbles to escape from the enclosed cavity. Examples of suitable materials for the seals include ceramic and ceramic mat (for example, a ceramic mat retaining a catalytic converter monolith), glass, and metal. In some embodiments, the seals may comprise metal flanges, for example, extending from the inner or outer pipe.

Insulated double-walled exhaust system components according to the present invention may be fabricated into various exhaust system components. Examples include insulated double-walled exhaust pipes, insulated double-walled end cone(s) and spacer rings of a catalytic converter assembly, insulated double-walled walled whole catalytic converter assemblies, insulated exhaust manifolds, and insulated double-walled tail pipes. While glass bubbles used in practice of the present invention typically enjoy the benefits of relatively low density and thermal conductivity, they may be limited in their usefulness in exhaust components that will see temperatures in excess of about 650° C. where the glass bubbles typically begin to soften and coalesce. In the case of gasoline engines, the insulated double-walled exhaust system components may be useful as insulated double-walled exhaust pipes or tail pipes, but may not be suitable for exhaust manifolds or as end cones or spacer rings in catalytic converter assemblies. However, due to the lower exhaust temperatures typical of diesel engines, the insulated double-walled exhaust system components may be typically fabricated into, and utilized as, any exhaust system component such as, for example, those mentioned hereinbefore.

Insulated double-walled exhaust system components according to the present invention may be used, for example, in conjunction with utility engines, or with engines mounted with a motor vehicle such as, for example, a car, truck, or motorcycle.

One or more of the insulated double-walled exhaust system components can be used and combined in an exhaust system, for example, of a motor vehicle.

A wide variety of glass bubbles are commercially available or otherwise available by methods known in the art. Useful glass bubbles have a size distribution wherein, on a bulk volume basis, at least 90 percent of the glass bubbles have a size of less than 150, 120, 110, 100, 90 micrometers, or even less. In some embodiments, greater than 50 percent of the glass bubbles may have a size of greater than 30, 40, 50, 60, 80, 90, or even greater than 100 micrometers. Grading of sizes may be accomplished, for example, by methods well known in the art such as sieving or air classification. Typically, the true density (that is, the density without influence of the packing efficiency, and which may be determined, for example, by air pycnometry or by the Archimedes method) of the glass bubbles is in a range of from 0.05 to 0.4 grams per milliliter, more typically 0.1 to 0.15 grams per milliliter, although true densities outside of these ranges may also be used. Examples of commercially available glass bubbles include those available under the trade designation "SCOTCHLITE" glass bubbles from 3M Company, St. Paul, Minn. Examples include glass bubbles designated "S Series" (for example, "S15", "S22", "S32", "S35", or "S38") and "K Series" (for example, "K1", "K15", "K20", "K25", "K37", or "K46"). Mixtures of glass bubbles may also be used, for example, to create a bimodal distribution of sizes having high packing efficiency. If multiple insulated double walled exhaust system components are used in an exhaust system, each may utilize glass bubbles having different sizes and/or physical properties.

Without wishing to be bound by theory, it is believed that as compared to larger insulation particles the very small size of the glass bubbles of the present invention reduces convection of air trapped within the double-walled cavity, thereby reducing the rate of thermal transfer between the inner and outer pipes.

Insulated double-walled exhaust system components according to the present invention can be made, for example, by techniques known in the art for making insulated double walled exhaust system components, except substituting glass bubbles according to the present invention for conventional insulating material. For example, in a first step, the inner pipe may be at least partially disposed within the outer pipe. In a second step, a fillable cavity is formed between the inner and outer pipes by forming a first seal (for example, as described hereinabove). Subsequent to either of these first or second steps, either or both of the inner and outer pipes may be bent or otherwise deformed to a desired shape. Glass bubbles are introduced into the fillable cavity (for example, by pouring or blowing), optionally with vibration during filling to assist in achieving a desired (for example, typically high) packing density. Once the fillable cavity is filled to a desired degree a second seal is created between the inner and outer pipes that serves to confine the glass bubbles in an enclosed cavity defined by the inner and outer pipes and the first and second seals.

In another method, both seals can be in place before the glass bubbles are introduced. This may be accomplished by drilling a suitable hole, typically in the outer pipe, which is then sealed after filling the cavity between the inner and outer pipes and the seals.

Objects and advantages of this invention are further illustrated by the following non-limiting examples, but the particular materials and amounts thereof recited in these examples, as well as other conditions and, details, should not be construed to unduly limit this invention.

EXAMPLES

A 30-inch (91-cm) length of stainless steel double wall pipe was constructed. The inner pipe had an outside diameter (OD) of 2½ inches (63.5 mm) and an inside diameter (ID) of 2⅜" (60.3 mm). The outer pipe had an OD of 3.0 inches (76.2 mm) and an ID of 2⅞ inches (73.0 mm). This resulted in an annular gap of 4.75 mm. The pipes were connected on one end with an annular seal made of stainless steel that was welded in place. The other end of the pipe had an annular stainless steel seal that was removable and could be fastened to the pipes with four machine screws. The annular gap was uniform around the inner pipe.

The pipe was equipped with thermocouples. Each thermocouple was 18 inches (45.7 cm) from the inlet end of the pipe (the inlet end was the end with the welded seal). A ⅛-inch (3.18-mm) sheathed thermocouple was located on the pipe center line to measure gas temperature. A second thermocouple was welded to the OD of the inner pipe. A third thermocouple was welded to the OD of the outer pipe. All thermocouples were located 18 inches (46 cm) from the inlet end of the pipe.

The pipe was first tested with the removable annular seal in place, but with the double wall pipe containing only air. It was connected to a 7.5-liter, Ford V-8 engine, and was oriented with its axis in the vertical direction.

The engine was run under various conditions as reported in Table 1 (below) until the gas temperature was stabilized and the OD of the outer pipe reached equilibrium.

After cooling back to room temperature, the removable seal was removed, and glass bubbles (available as "SCOTCHLITE K1" glass bubbles from 3M Company) were poured into the annular space of the double-wall pipe. As the pipe was being filled, the pipe was tapped on a table several times to compact the glass bubbles until the pipe was completely full of glass bubbles. Then, the removable annular seal was screwed in place and the bubble-filled pipe was tested the same way the empty pipe was. This procedure was also repeated except using glass bubbles available as "SCOTCHLITE K37" and "SCOTCHLITE S60" glass bubbles from 3M Company.

Results of testing are reported in Tables 1 and 2 (below) wherein the term "NA" means "not applicable". In Table 1, the exhaust gas flow rate is reported in standard cubic feet per minute (SCFM). One standard cubic foot is the amount of a gas as 60° F. (15.5° C.) that is contained in one cubic foot (28 liters) of the gas at a pressure of 14.696 pounds per square inch (psi) (101.33 kPa).

TABLE 1

| ENGINE | | | | STABILIZED GAS TEMPERATURE, ° C. | | | |
|---|---|---|---|---|---|---|---|
| SPEED, revolutions per minute | TORQUE, foot-pounds (N-m) | EXHAUST GAS FLOW RATE, SCFM | TIME, minutes | SCOTCHLITE K1 GLASS BUBBLES | AIR GAP | SCOTCHLITE K37 GLASS BUBBLES | SCOTCHLITE S60 GLASS BUBBLES |
| 1300 | 50 (68) | 49 | 30 | 283 | 303 | 308 | 307 |
| 1600 | 80 (110) | 70 | 30 | 398 | 418 | 418 | 414 |
| 1900 | 110 (150) | 97 | 30 | 493 | 511 | 509 | 505 |
| 2200 | 140 (190) | 123 | 30 | 569 | 586 | 583 | 581 |
| 2500 | 170 (230) | 153 | 30 | 635 | 648 | 648 | 646 |

TABLE 2

| INSULATION TYPE | TRUE DENSITY, grams per milliliter | SIZE RANGE 10th volume percentile, mm | SIZE RANGE 50th volume percentile, mm | SIZE RANGE 90th volume percentile, mm | TEMPERATURE, ° C. | | | | |
|---|---|---|---|---|---|---|---|---|---|
| | | | | | EXHAUST GAS | INNER TUBE | OUTER TUBE | DIFFERENCE | IMPROVEMENT OVER AIR GAP |
| Air Gap | NA | NA | NA | NA | 648 | 605 | 333 | 272 | 0 |
| SCOTCHLITE K1 glass bubbles | 0.125 | 0.03 | 0.065 | 0.11 | 635 | 598 | 278 | 320 | 48 |

TABLE 2-continued

| INSULATION TYPE | TRUE DENSITY, grams per milliliter | SIZE RANGE 10th volume percentile, mm | SIZE RANGE 50th volume percentile, mm | SIZE RANGE 90th volume percentile, mm | TEMPERATURE, ° C. EXHAUST GAS | INNER TUBE | OUTER TUBE | DIFFERENCE | IMPROVEMENT OVER AIR GAP |
|---|---|---|---|---|---|---|---|---|---|
| SCOTCHLITE K37 glass bubbles | 0.37 | 0.02 | 0.04 | 0.08 | 648 | 610 | 295 | 315 | 43 |
| SCOTCHLITE S60 glass Bubbles | 0.6 | 0.015 | 0.03 | 0.055 | 646 | 606 | 314 | 292 | 20 |

Various modifications and alterations of this invention may be made by those skilled in the art without departing from the scope and spirit of this invention, and it should be understood that this invention is not to be unduly limited to the illustrative embodiments set forth herein.

What is claimed is:

1. An insulated double-walled exhaust system component comprising an inner pipe, an outer pipe surrounding the inner pipe, first and second annular seals connecting the inner and outer pipes and together with the inner and outer pipes defining an enclosed cavity, and glass bubbles substantially filling the enclosed cavity, the glass bubbles having a size distribution wherein, on a bulk volume basis, at least 90 percent of the glass bubbles have a size of less than 90 micrometers.

2. An insulated double-walled exhaust system component according to claim 1, wherein the inner pipe comprises, steel, or a steel alloy.

3. An insulated double-walled exhaust system component according to claim 1, wherein the first and second annular seals comprise metal flanges.

4. An insulated double-walled exhaust system component according to claim 1, wherein the glass bubbles are tightly packed.

5. An insulated double-walled exhaust system component according to claim 1, wherein, on a bulk volume basis, greater than 50 percent of the glass bubbles have a size of greater than 50 micrometers.

6. An insulated double-walled exhaust system component according to claim 1, wherein the glass bubbles have a true density in a range of from 0.1 to 0.15 grams per milliliter.

7. An insulated double-walled exhaust system component according to claim 1, wherein the insulated double-walled exhaust system component is selected from the group consisting of an exhaust pipe, at least a portion of a catalytic converter assembly, and a tail pipe.

8. An insulated double-walled exhaust system component according to claim 1, wherein the insulated double-walled exhaust system component is selected from the group consisting of an insulated double-walled exhaust pipe, an insulated double-walled end cone of a catalytic converter assembly, an insulated double-walled spacer ring of a catalytic converter assembly, an insulated double-walled muffler, and an insulated double-walled tail pipe.

9. An insulated double-walled exhaust system component according to claim 1, connected to a diesel engine such that exhaust gas from the diesel engine is directed through the inner pipe.

10. An insulated double-walled exhaust system component according to claim 9, wherein the exhaust system component is disposed upstream of a catalytic converter.

11. An insulated double-walled exhaust system component according to claim 9, wherein the component comprises an insulated double-walled exhaust pipe.

12. An insulated double-walled exhaust system component according to claim 9, wherein the component comprises an end cone or spacer ring of a catalytic converter assembly.

13. An insulated double-walled exhaust system component according to claim 9, wherein the component comprises an insulated double-walled tail pipe.

14. A method of making an insulated double-walled exhaust system component, the method comprising:

providing an inner pipe;

at least partially confining the inner pipe within an outer pipe;

connecting the inner and outer pipes to form a fillable cavity having at least one opening;

substantially filling the fillable cavity with glass bubbles having a size distribution wherein, on a bulk volume basis, at least 90 percent of the glass bubbles have a size of less than 90 micrometers; and sealing said at least one opening and enclosing the glass bubbles.

15. A method of making an insulated double-walled exhaust system component according to claim 14, wherein the inner pipe and outer pipe are connected by at least one seal, and wherein the inner pipe, outer pipe, said at least one seal, and the opening form the fillable cavity.

16. A method of making an insulated double-walled exhaust system component according to claim 15, wherein said at least one seal comprises a metal flange.

17. A method of making an insulated double-walled exhaust system component according to claim 14, wherein the inner pipe comprises stainless steel, steel, or a steel alloy.

18. A method of making an insulated double-walled exhaust system component according to claim 14, wherein, on a bulk volume basis, greater than 50 percent of the glass bubbles have a size of greater than 50 micrometers.

19. A method of making an insulated double-walled exhaust system component according to claim 14, wherein the glass bubbles have a true density in a range of from 0.1 to 0.15 grams per milliliter.

20. A method of making an insulated double-walled exhaust system component according to claim 14, wherein the insulated double-walled exhaust system component is selected from the group consisting of an insulated double-walled exhaust pipe, an insulated double-walled end cone of a catalytic converter assembly, an insulated double-walled spacer ring of a catalytic converter assembly, an insulated double-walled muffler, and an insulated double-walled tail pipe.

* * * * *